US007204231B2

(12) United States Patent
Muto et al.

(10) Patent No.: US 7,204,231 B2
(45) Date of Patent: Apr. 17, 2007

(54) CONTROL DEVICE OF INTERNAL COMBUSTION ENGINE

(75) Inventors: Harufumi Muto, Nishikamo-gun (JP); Yuichiro Ido, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/247,261

(22) Filed: Oct. 12, 2005

(65) Prior Publication Data

US 2006/0081216 A1 Apr. 20, 2006

(30) Foreign Application Priority Data

Oct. 19, 2004 (JP) ..... 2004-304331

(51) Int. Cl.
*F02D 11/10* (2006.01)
*F02D 41/14* (2006.01)

(52) U.S. Cl. ..... 123/399; 123/361

(58) Field of Classification Search ..... 123/352, 123/361, 399

See application file for complete search history.

(56) References Cited

U.S. PATENT DOCUMENTS 4,791,902 A * 12/1988 Ishikawa et al. ..... 123/399
4,799,467 A * 1/1989 Ishikawa et al. ..... 123/399
5,282,449 A 2/1994 Takahashi et al.
5,611,309 A * 3/1997 Kumagai et al. ..... 123/399
6,305,351 B1 * 10/2001 Neumann et al. ..... 123/399
6,986,337 B2 * 1/2006 Muto ..... 123/399

FOREIGN PATENT DOCUMENTS

JP A 5-65845 3/1993
JP A 2001-41095 2/2001

* cited by examiner

*Primary Examiner*—T. M. Argenbright
(74) *Attorney, Agent, or Firm*—Oliff & Berridge, PLC

(57) ABSTRACT

A control device of an internal combustion engine which determines a target throttle opening degree in accordance with a required intake pipe internal pressure and which suppresses the occurrence of hunting of the throttle opening degree is provided, wherein, when the required intake pipe internal pressure becomes a predetermined pressure or more, the target throttle opening degree is determined by adding an addition-corrected throttle opening degree calculated in accordance with a difference between the required intake pipe internal pressure and the predetermined pressure based on a predetermined equation to an opening degree of a throttle valve making the intake pipe internal pressure the predetermined pressure.

6 Claims, 5 Drawing Sheets

CONTROL DEVICE OF INTERNAL COMBUSTION ENGINE

BACKGROUND OF THE INVENTION

1. Field of the Invention

The present invention relates to a control device of an internal combustion engine.

2. Description of the Related Art

Known in the art is a control device of an internal combustion engine setting an intake air amount in accordance with an amount of depression of an accelerator etc. expressing a requirement of the driver of the vehicle (that is, the target intake air amount), finding a target opening degree of the throttle valve based on the required intake air amount (that is, the target throttle opening degree), and controlling the opening degree of the throttle valve (that is, the throttle opening degree) to this target throttle opening degree to control the intake air amount (for example, see Japanese Unexamined Patent Publication No. 5-65845).

In such a control device of an internal combustion engine, the target throttle opening degree is made a throttle opening degree whereby the pressure in the intake pipe at the downstream side of the throttle valve becomes the intake pipe internal pressure for realizing the required intake air amount (that is, the required intake pipe internal pressure). Further, on the other hand, in general, the effect of a change of the opening degree of the throttle valve on the intake pipe internal pressure (that is, the effect on the intake air amount) becomes extremely small in the region with a large throttle opening degree, that is, in the region with a large intake pipe internal pressure.

From this, in the region with a large throttle opening degree, that is, in the region with a large intake pipe internal pressure, even if the operating conditions of the engine change slightly and the required intake air amount changes slightly correspondingly, the throttle opening degree is made to greatly change to realize a change of the required intake pipe internal pressure corresponding to this and hunting of the throttle opening degree occurs in some cases. Further, the occurrence of such hunting has a detrimental effect on the durability of the throttle valve and also becomes a factor causing deterioration of the robustness of control.

SUMMARY OF THE INVENTION

An object of the present invention is to provide a control device of an internal combustion engine which determines a target throttle opening degree in accordance with a required intake pipe internal pressure reflecting the requirements of the driver and which suppresses the occurrence of hunting of the throttle opening degree.

According to the present invention, there is provided a control device of an internal combustion engine determining a target throttle opening degree in accordance with a required intake pipe internal pressure reflecting the requirements of a driver, wherein, when the required intake pipe internal pressure becomes a predetermined pressure or more, the target throttle opening degree is determined by adding an addition-corrected throttle opening degree calculated in accordance with a difference between the required intake pipe internal pressure and the predetermined pressure based on a predetermined equation to an opening degree of a throttle valve making the intake pipe internal pressure the predetermined pressure.

This predetermined equation may be expressed by a linear equation expressing a relationship between the addition corrected throttle opening degree and the difference between the required intake pipe internal pressure and predetermined pressure.

According to the present invention, by suitably setting the above predetermined equation, it is possible to suppress operation of the throttle valve and possible to suppress the occurrence of hunting when the required intake pipe internal pressure becomes a predetermined pressure or more and hunting of the throttle opening degree is liable to occur.

The inclination of the line expressed by the linear equation may be made the same as the inclination of the line passing through the point at which the intake pipe internal pressure becomes the above predetermined pressure on the curve expressing the relationship between the opening degree of the throttle valve and the intake pipe internal pressure and the point where the ratio of change of the intake pipe internal pressure with respect to the change in opening degree of the throttle valve becomes a predetermined value or less.

By suitably setting the above predetermined value, when determining the target throttle opening degree when the required intake pipe internal pressure becomes the predetermined pressure or more, it becomes possible to make the ratio (or magnitude) of the change of the target throttle opening degree with respect to a change of the required intake pipe internal pressure an allowable value or less. Further, due to this, it is possible to suppress operation of the throttle valve and possible to suppress the occurrence of hunting when the required intake pipe internal pressure is large and hunting of the throttle opening degree is liable to occur.

Further, as the predetermined equation, it is possible to use a reference equation found so as to correspond to a predetermined reference engine speed corrected using the ratio between the reference engine speed and the engine speed when determining the target throttle opening degree. By doing this, it is possible to realize control of the intake air amount suppressing the occurrence of hunting with a smaller control load.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
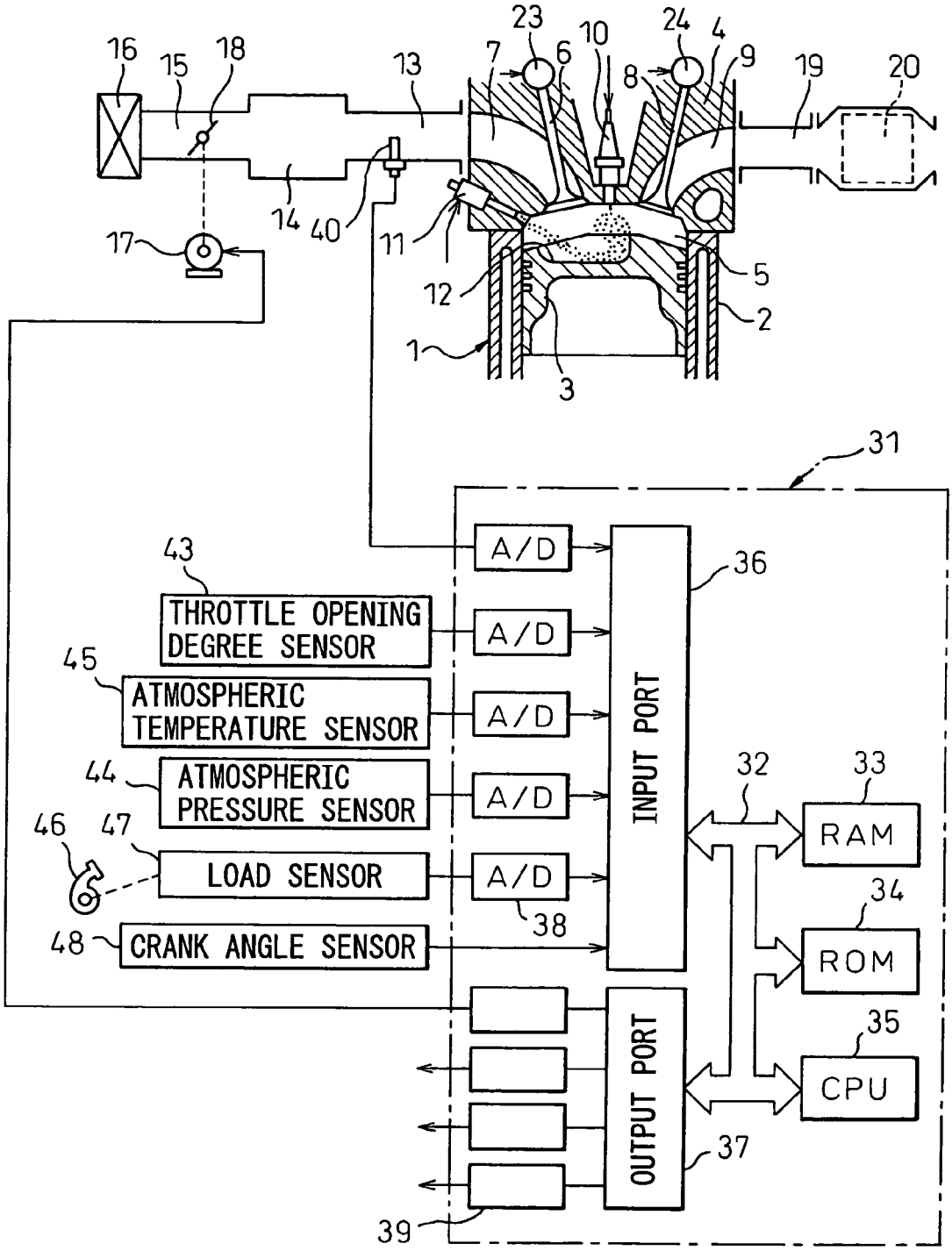
FIG. 1 is a schematic view of an example of the case of application of the control device of an internal combustion engine of the present invention to an in-cylinder injection, spark ignition type internal combustion engine.

Next, embodiments of the present invention will be explained in detail with reference to the drawings. FIG. 1 is a schematic view of an example of the case of application of the present invention to an in-cylinder injection, spark ignition type internal combustion engine. Note that the present invention may also be applied to another spark ignition type internal combustion engine or a compression ignition type internal combustion engine.

As shown in FIG. 1, an engine body 1 is provided with a cylinder block 2, pistons 3 moving reciprocating inside the cylinder block 2, and a cylinder head 4 fixed to the cylinder block 2. Each piston 3 and the cylinder head 4 form between them a combustion chamber 5. The cylinder head 4 is provided with an intake valve 6, intake port 7, exhaust valve 8, and exhaust port 9 for each cylinder. The intake valves 6 and exhaust valves 8 are provided with variable valve timing mechanisms 23 and 24, respectively, for changing the operating timings of the valves. Further, as shown in FIG. 1, the centers of the inside walls of the cylinder heads 4 are provided with spark plugs 10, while the peripheries of the inside walls of the cylinder heads 4 are provided with fuel injectors 11. Further, the top faces of the pistons 3 are formed with cavities 12 extending from below the fuel injectors 11 to below the spark plugs 10.

The intake ports 7 of the cylinders are connected to a surge tank 14 through downstream side intake tubes 13. The surge tank 14 is connected to an air cleaner 16 through the upstream side of the intake pipe 15. The intake pipe 15 is provided inside it with a throttle valve 18 driven by a step motor 17. On the other hand, the exhaust ports 9 of the cylinders are connected to the exhaust pipe 19. This exhaust pipe 19 is connected to an exhaust purification device 20.

An electronic control unit (ECU) 31 is comprised of a digital computer provided with a random access memory (RAM) 33, a read-only memory (ROM) 34, a microprocessor (CPU) 35, an input port 36, and an output port 37 connected with each other via a bi-directional bus 32. The intake pipe 13 is provided with an intake pipe internal pressure sensor 40 for detecting the pressure in the intake pipe at the downstream side from the throttle valve 18 (intake pipe internal pressure). The intake pipe internal pressure sensor 40 generates an output voltage proportional to the intake pipe internal pressure and this output voltage is input through a corresponding AD converter 38 to the input port 36.

Further, a throttle opening degree sensor 43 for detecting the opening degree of the throttle valve 18, an atmospheric pressure sensor 44 for detecting the pressure of the atmosphere around the internal combustion engine or the pressure of the air sucked into the intake pipe 15 (intake pressure), and an atmospheric temperature sensor 45 for detecting the temperature of the atmosphere around the internal combustion engine or the temperature of the air sucked into the intake pipe 15 (intake temperature) are provided. The output voltages of these sensors are input to the input port 36 through the corresponding AD converters 38.

The accelerator pedal 46 is connected to a load sensor 47 generating an output voltage proportional to the amount of depression of the accelerator pedal 46 (that is, the amount of accelerator depression). The output voltage of the load sensor 47 is input to the input port 36 through the corresponding AD converter 38. The crank angle sensor 48 for example generates an output pulse with each 30-degree rotation of the crank shaft. This output pulse is input to the input port 36. The CPU 35 calculates the engine speed from the output pulses of the crank angle sensor 48.

On the other hand, the output port 37 is connected through the corresponding drive circuits 39 to the spark plugs 10, fuel injectors 11, step motor 17, etc. Due to this, signals from the ECU 31 can be used to control the amounts and timings of injection of fuel by the fuel injectors 11, the ignition timings of the spark plugs 10, and the opening degree of the throttle valve 18. Note that in this embodiment, the opening degree of the throttle valve 18 can be changed regardless of the amount of accelerator depression. By adjusting the opening degree of the throttle valve 18, it is possible to control the pressure in the intake pipe at the downstream side of the throttle valve. Further, the variable valve timing mechanisms 23 and 24 are also controlled by the ECU 31.

Known in the past however is a control device of an internal combustion engine setting the required intake air amount in accordance with the accelerator depression etc. expressing the requirements of the driver of the vehicle, determining the target opening degree of the throttle valve (target throttle opening degree) in accordance with the required intake air amount, and controlling the throttle opening degree to this target throttle opening degree so as to control the intake air amount.

In such a control device of an internal combustion engine, in general, first the required torque is found based on the accelerator depression, engine speed, shift position, and other operating conditions, then the required intake air amount is found based on the required torque. Further, the intake pipe internal pressure at the downstream side of the throttle valve for realizing this required intake air amount, that is, the required intake pipe internal pressure, is found, then the throttle opening degree by which the intake pipe internal pressure becomes the required intake pipe internal pressure is found and used as the target throttle opening degree.

However, in the case that the throttle opening degree for realizing this required intake pipe internal pressure is made the target throttle opening degree as it is, the throttle opening degree will fluctuate largely (hunting) and as a result the frequency of operation of the throttle valve will increase and the durability of the throttle valve etc. will be detrimentally affected.

That is, the effect of a change of the opening degree of the throttle valve on the intake pipe internal pressure (therefore the effect on the intake air amount) generally becomes extremely small in the region of a large throttle opening degree, that is, a region of a large intake pipe internal pressure. Therefore, in the above-mentioned case, in the region with a large throttle opening degree, that is, a region with a large intake pipe internal pressure, even if the operating conditions of the engine change slightly and the required intake air amount changes just slightly corresponding to this, the target throttle opening degree fluctuates greatly for realizing the change of the required intake pipe internal pressure corresponding to this. As a result, the throttle opening degree ends up hunting in some cases.

In this embodiment, considering the above point, the throttle opening degree is controlled as explained below so as to suppress the occurrence of hunting of the throttle opening degree. That is, in this embodiment, the throttle opening degree is controlled as shown in the control routine of FIG. 2 for control of the intake air amount.

Figure 2:
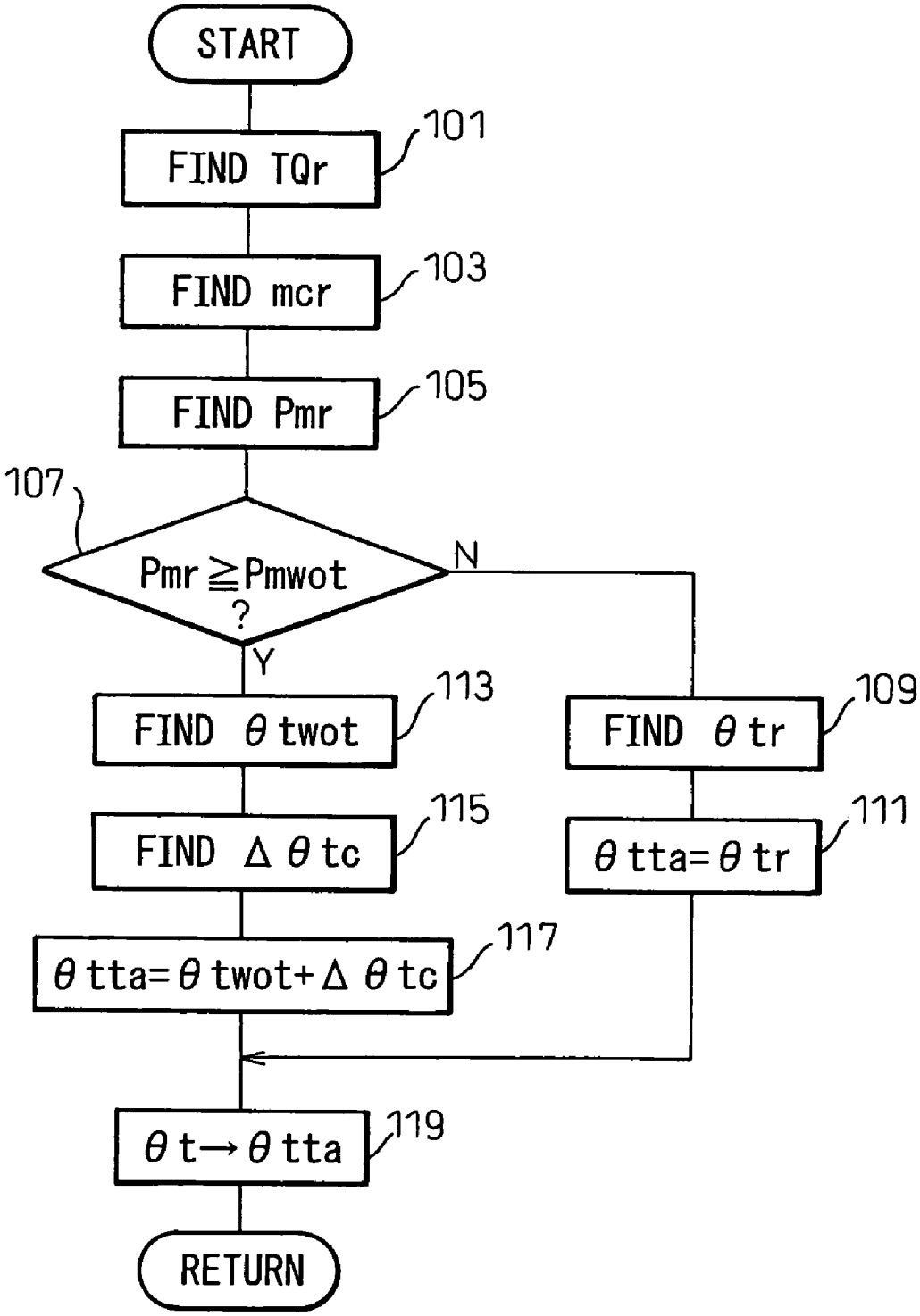
FIG. 2 is a flow chart of a control routine for throttle opening degree control in an embodiment of the present invention.

When the control routine of FIG. 2 starts, first, at step 101, the required torque TQr is found. This can be found based on for example the amount of accelerator depression L, the engine speed NE, the shift position, and other operating conditions. Specifically, in the present embodiment, a map linking the required torque TQr with the operating conditions (that is, a map obtained so that a required torque TQr is found using the acceleration depression L, engine speed NE, and shift position as arguments) is prepared in advance and used for finding the torque.

When the required torque TQr is found at step 101, the routine proceeds to step 103, where the required intake air amount mcr is found. The required intake air amount mcr is the intake air amount for realizing the required torque TQr. In the present embodiment, a map linking the required torque TQr and the required intake air amount mcr is prepared in advance. The required intake air amount mcr is found using the required torque TQr found at step 101 based on this map. Note that the required intake air amount mcr here may be a value expressed by any of the average flow rate of the intake air (g/s), the amount of air filled into the cylinders (g), and the cylinder air filling rate.

When the required intake air amount mcr is found at step 103, the routine proceeds to step 105. At step 105, the required intake air amount mcr found at step 103 is used to find the required intake pipe internal pressure Pmr. The required intake pipe internal pressure Pmr is the intake pipe internal pressure at the downstream side of the throttle valve for realizing the required intake air amount mcr. In the present embodiment, a map linking the required intake air amount mcr and required intake pipe internal pressure Pmr is prepared in advance and this map is used to find the required intake pipe internal pressure Pmr.

When the required intake pipe internal pressure Pmr is found at step 105, the routine proceeds to step 107. At step 107, it is judged if the required intake pipe internal pressure Pmr found at step 105 is a predetermined pressure Pmwot or more. The judgment here is for judging if the required intake pipe internal pressure Pmr found at step 105 is in the region where hunting of the throttle opening degree easily occurs or the region where it would not easily occur. Therefore, the pressure Pmwot is suitably set in accordance with the properties of the control performed (that is, how much stress is placed on the suppression of hunting in the control performed), but for example it can be made the pressure at which the ratio (or magnitude) of change of the intake pipe internal pressure corresponding to change of throttle opening degree starts to become no longer sufficient and can be made a pressure relatively closer to the atmospheric pressure.

The case where it is judged at step 107 that the required intake pipe internal pressure Pmr is less than the pressure Pmwot is the case where it is judged that hunting of the throttle opening degree is relatively difficult to occur. In this case, the routine proceeds to step 109, where the required throttle opening degree θtr is found. The required throttle opening degree θtr is the throttle opening degree θt for realizing the required intake pipe internal pressure Pmr and for realizing the required intake air amount mcr.

Figure 3:
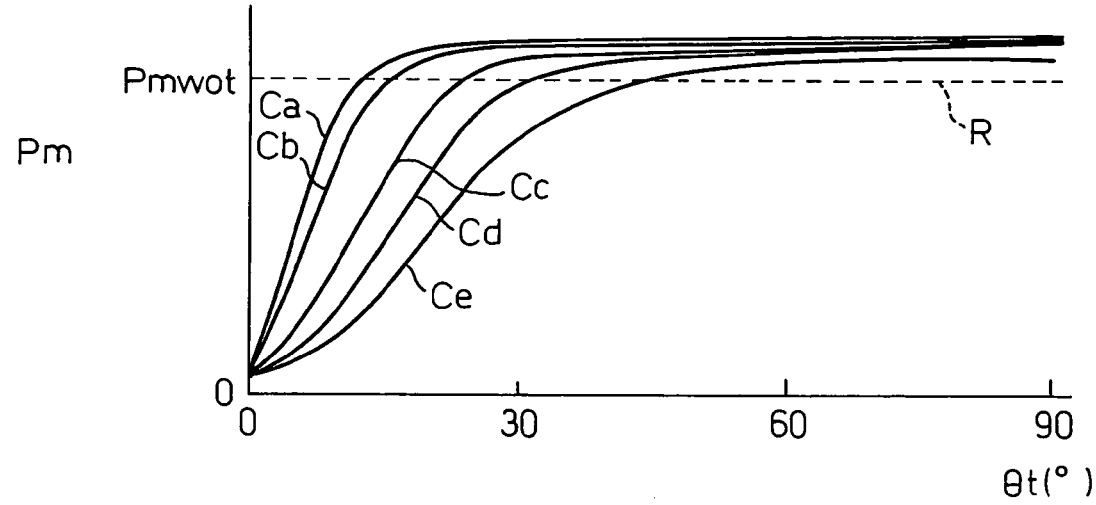
FIG. 3 is an example of a map linking the intake pipe internal pressure Pm and throttle opening degree θt for realizing the intake pipe internal pressure Pm.

The required throttle opening degree θtr is found using the map such as shown in FIG. 3. The map of FIG. 3 links the intake pipe internal pressure Pm and the throttle opening degree θt for realizing the intake pipe internal pressure Pm. In this example, the relations between the intake pipe internal pressure Pm and the throttle opening degree θt for the five different engine speeds NEa, NEb, NEc, NEd, and NEe are expressed by the curves Ca, Cb, Cc, Cd, and Ce. Note that here NEa<NEb<NEc<NEd<NEe.

In the present embodiment, the map shown in FIG. 3 is prepared in advance. At step 109, the required throttle opening degree θtr is found based on this map from the required intake pipe internal pressure Pmr found at step 105. Further, when the required throttle opening degree θtr is found at step 109, the routine proceeds to step 111, where the required throttle opening degree θtr is made the target throttle opening degree θtta as it is.

On the other hand, the case where it is judged at step 107 that the required intake pipe internal pressure Pmr is the pressure Pmwot or more is the case where it is judged that hunting of the throttle opening degree will occur relatively easily. In this case, the routine proceeds to step 113. At step 113, the throttle opening degree θtwot making the intake pipe internal pressure Pm the pressure Pmwot is found. This throttle opening degree θtwot can also be found from the map such as shown in FIG. 3. That is, for example, if the engine speed NE at that time is NEc, the throttle opening degree θtwot to be found is a value on the abscissa at the intersection of the curve Cc and the broken line R showing that the intake pipe internal pressure Pm is the pressure Pmwot in FIG. 3.

When the throttle opening degree θtwot is found at step 113, next, at step 115, the addition corrected throttle opening degree Δθtc is found. The addition corrected throttle opening degree Δθtc can be found using the map shown in for example FIG. 4. The map of FIG. 4 links the difference ΔPm between the required intake pipe internal pressure Pmr and the predetermined pressure Pmwot (that is, the ΔPm=Pmr−Pmwot) and the addition corrected throttle opening degree Δθtc. The example of FIG. 4 shows the case where the engine speed NE is NEc.

Further, the map shown in FIG. 4 able to be used here can be obtained in the following way. That is, the parts of the curves Ca, Cb, Cc, Cd, and Ce (shown in FIG. 3) showing the relationships between the intake pipe internal pressure Pm and the throttle opening degree θt for realizing the intake pipe internal pressure Pm where the intake pipe internal pressure Pm is the pressure Pmwot or more are made straight lines such as shown by the dot-chain lines in FIG. 5. The lines fa, fb, fc, fd, and fe obtained by this conversion specifically are the lines passing through the intersections of the curves Ca, Cb, Cc, Cd, and Ce with the broken line R showing that the intake pipe internal pressure Pm is the pressure Pmwot and the points on the curves Ca, Cb, Cc, Cd, and Ce where the inclinations become less than predetermined values, in other words, the lines passing through the points on the curves Ca, Cb, Cc, Cd, and Ce where the intake pipe internal pressure Pm becomes the predetermined pressure Pmwot and the point where the ratio (or magnitude) of change of the intake pipe internal pressure Pm with respect to change of the opening degree of the throttle valve becomes the above predetermined value or less. Here, as the predetermined value, for example, the allowable lower limit of the ratio of change of the intake pipe internal pressure Pm with respect to change of the opening degree of the throttle valve is used.

Next, the lines when moving the starting points of the lines fa, fb, fc, fd, and fe obtained in this way (that is, the intersections between the curves Ca, Cb, Cc, Cd, and Ce and the broken line R) to the origin of the coordinates are found. These lines are conversion lines for converting the pressure difference ΔPm to the addition corrected throttle opening degree Δθtc. Due to this, the map shown in FIG. 4 is formed.

Figure 4:
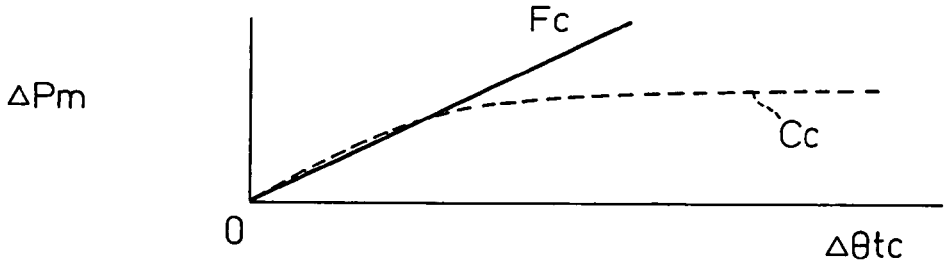
FIG. 4 is an example of a map linking a difference ΔPm between a required intake pipe internal pressure Pmr and a predetermined pressure Pmwot and an addition corrected throttle opening degree Δθtc.
Figure 5:
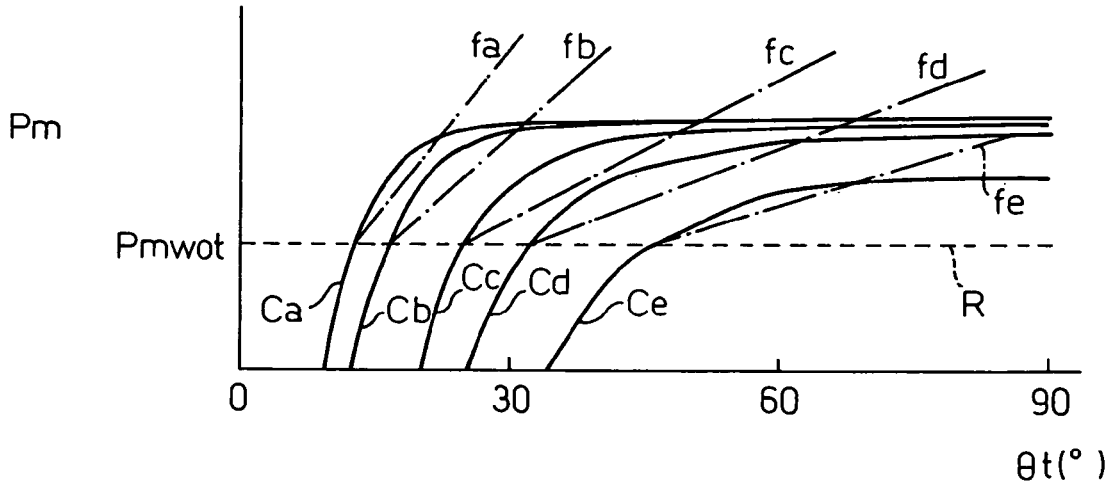
FIG. 5 is a view for explaining the method for obtaining the map such as shown in FIG. 4, that is, the conversion curve.

That is, for example, FIG. 4 is an example of the case where the engine speed NE is NEc, and the conversion line Fc shown in the map of FIG. 4 is the line when moving the starting point of the line fc of FIG. 3 to the origin of the coordinates.

Note that the lines fa, fb, fc, fd, and fe and the conversion lines obtained from the same (for example, the conversion line Fc) naturally can be expressed by a linear equation. That is, for example, each conversion line (for example, the conversion line Fc) can be expressed by a linear equation expressing the relationship between the addition corrected throttle opening degree Δθtc and the pressure difference ΔPm. More specifically, for example the conversion line Fc shown in FIG. 4 can be expressed by ΔPm=C·Δθtc or Δθtc=C'·ΔPm (herein, C and C' are coefficients expressing the inclinations of the lines, and C=1/C'). Further, as clear from the above explanation, the lines fa, fb, fc, fd, and fe and the conversion lines obtained from the same are the same in inclination.

In the present embodiment, the equation of the conversion line used in the map shown in FIG. 4 is found in advance. At step 115, the addition corrected throttle opening degree Δθtc is found in accordance with the pressure difference ΔPm based on the equation of the conversion line. Note that this is substantially the same as finding the addition corrected throttle opening degree Δθtc in accordance with the pressure difference ΔPm based on this map.

When the addition corrected throttle opening degree Δθtc is found at step 115, the routine proceeds to step 117, where the sum of the throttle opening degree θtwot found at step 113 and the addition corrected throttle opening degree Δθtc is found and used as the target throttle opening degree θtta (that is, θtta=θtwot+Δθtc).

Further, in the above way, if the target throttle opening degree θtta is determined at step 111 or step 117, at the next step 119, the throttle valve 18 is controlled so that the throttle opening degree θt becomes the target throttle opening degree θtta to control the intake air amount. Further, when step 119 ends, the routine returns to step 101, from where the similar control is repeated.

As explained above, according to the present embodiment, when the required intake pipe internal pressure Pmr becomes the predetermined pressure Pmwot or more and hunting of the throttle opening degree θt is feared, it is possible to make the ratio of change of the intake pipe internal pressure Pm with respect to changes in the opening degree of the throttle valve envisioned when determining the target throttle opening degree θtta the allowable lower limit or more. This means that when hunting of the throttle opening degree θt is liable to occur, when determining the target throttle opening degree θtta, the ratio of change of the target throttle opening degree θtta with respect to a change in the required intake pipe internal pressure Pmr can be made an allowable value or less. As a result, it is possible to suppress operation of the throttle valve and possible to suppress the occurrence of hunting.

Next, another embodiment of the present invention will be explained. This embodiment can be realized by the configuration shown in FIG. 1 and has many parts in common with the above embodiment. Explanation of the parts in common will in principle be omitted.

As explained above, in the above embodiment, when finding the addition corrected throttle opening degree Δθtc, a linear equation (or map) expressing a conversion line in accordance with the engine speed at that time is used, so a large number of linear equations (or maps) had to be prepared. As opposed to this, in the present embodiment, only a linear equation (or map) expressing the conversion line corresponding to a reference engine speed NEk, that is, a reference equation (or map), is provided. When finding the addition corrected throttle opening degree Δθtc, the reference addition corrected throttle opening degree Δθtck found based on the reference equation (or reference map) is corrected using the ratio of the reference engine speed NEk and actual engine speed NEn. That is, in other words, when finding the addition corrected throttle opening degree Δθtc in this embodiment, the reference equation (or reference map) is used corrected by the ratio of the reference engine speed NEk and actual engine speed NEn.

Figure 6:
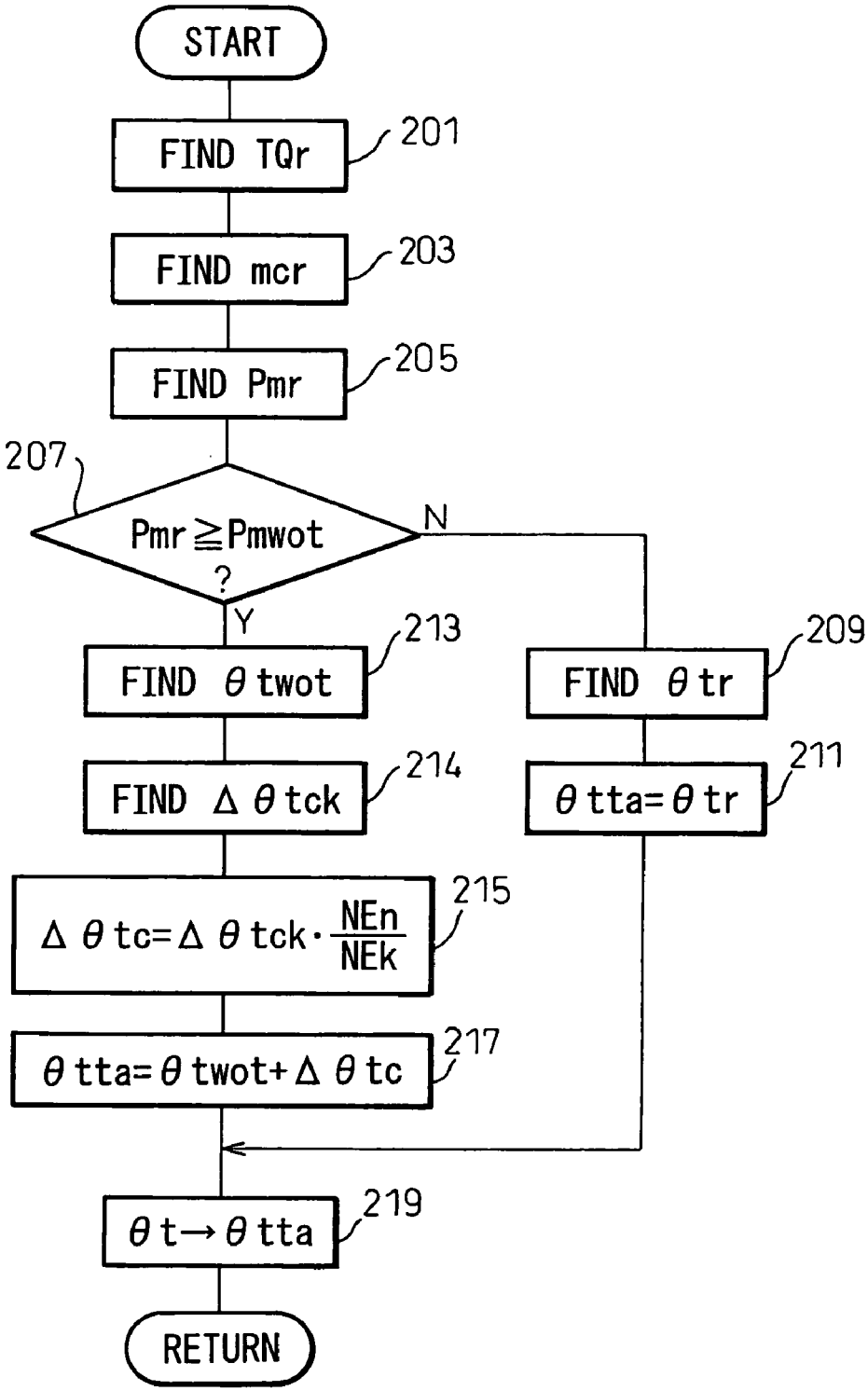
FIG. 6 is a flow chart of a control routine for throttle opening degree control in another embodiment of the present invention.

FIG. 6 is a flow chart showing the control routine for controlling the throttle opening degree performed in this embodiment. The control at steps 201, 203, 205, 207, 209, 211, and 213 in this control routine is similar to the control at steps 101, 103, 105, 107, 109, 111, and 113 in the control routine shown in FIG. 2, so the explanation will be omitted here.

If the throttle opening degree θtwot making the intake pipe internal pressure Pm the pressure Pmwot is found at step 213, the routine proceeds to step 214 where a reference addition corrected throttle opening degree Δθtck in the case where the engine speed NE is a predetermined reference engine speed NEk is found. The control here is substantially the same as the control of step 115 in the control routine shown in FIG. 2 except that a reference equation (or reference map) which is a linear equation (or map) corresponding to the reference engine speed NEk is used. That is, for example, if the reference engine speed NEk is NEc, the reference addition corrected throttle opening degree Δθtck can be obtained by finding the addition corrected throttle opening degree Δθtc corresponding to the above pressure difference ΔPm (=Pmr−Pmwot) based on the linear equation expressing the line Fc shown in FIG. 4 (or map of FIG. 4).

When the reference addition corrected throttle opening degree Δθtck is found at step 214, the routine proceeds to step 215. At step 215, the reference addition corrected throttle opening degree Δθtck found at step 214 is corrected using the ratio of the reference engine speed NEk and actual engine speed NEn whereby the addition corrected throttle opening degree Δθtc is calculated. More specifically, here, the addition corrected throttle opening degree Δθtc is calculated by the following equation (1):

$$\Delta\theta tc = \Delta\theta tck \cdot \frac{NEn}{NEk} \tag{1}$$

Figure 7:
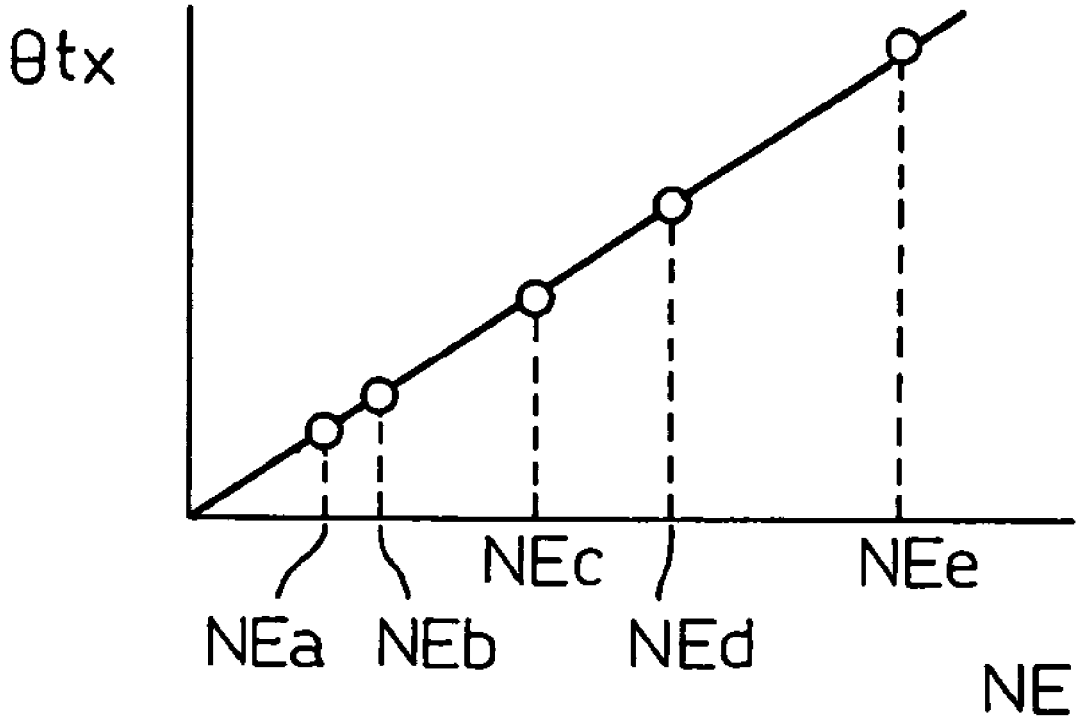
FIG. 7 is a view of the relationship between the change in throttle opening degree θtx corresponding to the unit change of pressure in the case based on a conversion line and the engine speed NE.

Note that here it is possible to correct the reference addition corrected throttle opening degree Δθtck by using the ratio of the reference engine speed NEk and the actual engine speed NEn and find the addition corrected throttle opening degree Δθtc in the case of the actual engine speed NEn in this way because the inclinations of the conversion lines (for example, the line Fc) differ depending on the engine speed NE and, when based on these conversion lines, the change in the throttle opening degree θtx corresponding to the unit change of pressure (that is, θtx=Δθtc/ΔPm) is substantially proportional to the engine speed NE (see FIG. 7).

When the addition corrected throttle opening degree Δθtc is found at step 215, the routine proceeds to step 217, where the sum of the throttle opening degree θtwot found at step 213 and the addition corrected throttle opening degree Δθt is found and made the target throttle opening degree θtta (that is, $\theta tta=\theta twot+\Delta\theta t$). The control at the next step 219 is similar to the control at step 119 in the control routine shown in FIG. 2.

As explained above, in the present embodiment, only a linear equation (or map) expressing a conversion line in accordance with the reference engine speed NEk is used in the above control of the throttle opening degree. Therefore, control of the intake air amount suppressing the occurrence of hunting is realized by a control load smaller than in the embodiment explained previously.

While the invention has been described with reference to specific embodiments chosen for purpose of illustration, it should be apparent that numerous modifications could be made thereto by those skilled in the art without departing from the basic concept and scope of the invention.

The invention claimed is:

1. A control device of an internal combustion engine determining a target throttle opening degree in accordance with a required intake pipe internal pressure reflecting the requirements of a driver, wherein, when said required intake pipe internal pressure becomes a predetermined pressure or more, the target throttle opening degree is determined by adding an addition-corrected throttle opening degree calculated in accordance with a difference between said required intake pipe internal pressure and said predetermined pressure based on a predetermined equation to an opening degree of a throttle valve making the intake pipe internal pressure said predetermined pressure.

2. A control device of an internal combustion engine as set forth in claim 1, wherein the predetermined equation is expressed by a linear equation expressing a relationship between the addition corrected throttle opening degree and the difference between the required intake pipe internal pressure and predetermined pressure.

3. A control device of an internal combustion engine as set forth in claim 2, wherein inclination of the line expressed by the linear equation is the same as the inclination of the line passing through the point at which the intake pipe internal pressure becomes the above predetermined pressure on the curve expressing the relationship between the opening degree of the throttle valve and the intake pipe internal pressure and the point where the ratio of change of the intake pipe internal pressure with respect to the change in opening degree of the throttle valve becomes a predetermined value or less.

4. A control device of an internal combustion engine as set forth in claim 1, wherein the predetermined equation used is a reference equation found so as to correspond to a predetermined reference engine speed corrected using the ratio between the reference engine speed and the engine speed when determining the target throttle opening degree.

5. A control device of an internal combustion engine as set forth in claim 2, wherein the predetermined equation used is a reference equation found so as to correspond to a predetermined reference engine speed corrected using the ratio between the reference engine speed and the engine speed when determining the target throttle opening degree.

6. A control device of an internal combustion engine as set forth in claim 3, wherein the predetermined equation used is a reference equation found so as to correspond to a predetermined reference engine speed corrected using the ratio between the reference engine speed and the engine speed when determining the target throttle opening degree.

* * * * *